US007389768B2

(12) United States Patent
Hayakawa et al.

(10) Patent No.: US 7,389,768 B2
(45) Date of Patent: Jun. 24, 2008

(54) PUMP MODULE HAVING SUB-TANK AND ELASTIC MEMBER

(75) Inventors: Tetsuo Hayakawa, Kariya (JP); Hideto Takahashi, Kariya (JP); Tadashi Hazama, Chita-gun (JP)

(73) Assignee: Denso Corporation, Kariya, Aichi-pref. (JP)

( * ) Notice: Subject to any disclaimer, the term of this patent is extended or adjusted under 35 U.S.C. 154(b) by 394 days.

(21) Appl. No.: 11/091,762

(22) Filed: Mar. 29, 2005

(65) Prior Publication Data

US 2005/0217733 A1 Oct. 6, 2005

(30) Foreign Application Priority Data

Mar. 30, 2004 (JP) ..... 2004-100164
Jan. 31, 2005 (JP) ..... 2005-023688

(51) Int. Cl.
*F02M 37/10* (2006.01)

(52) U.S. Cl. ..... 123/509; 137/565.34

(58) Field of Classification Search ..... 137/565.17, 137/565.34, 574, 576; 123/509
See application file for complete search history.

(56) References Cited

U.S. PATENT DOCUMENTS 4,869,225 A * 9/1989 Nagata et al. ..... 123/509
5,680,847 A * 10/1997 Begley et al. ..... 123/509
6,155,793 A * 12/2000 Tuckey et al. ..... 123/509
6,213,100 B1 * 4/2001 Johansen ..... 123/509
6,231,318 B1 * 5/2001 Cotton et al. ..... 123/509
6,260,543 B1 * 7/2001 Chih ..... 123/509
6,739,354 B2 * 5/2004 Oku et al. ..... 137/565.22
6,923,164 B1 * 8/2005 Mitsudou et al. ..... 123/509

FOREIGN PATENT DOCUMENTS

JP 2643436 5/1997
JP 2643461 5/1997

* cited by examiner

*Primary Examiner*—John Rivell
(74) *Attorney, Agent, or Firm*—Nixon & Vanderhye P.C.

(57) ABSTRACT

A pump module, which is mounted to a fuel tank, includes a sub-tank, a fuel pump and an elastic member. The sub-tank is accommodated in the fuel tank. The fuel pump is accommodated in the sub-tank to pump fuel drawn into the sub-tank. The elastic member is formed of an elastomer, and is interposed between a bottom portion of the sub-tank and a bottom portion of the fuel tank. The elastic member makes contact with fuel. The elastic member internally has spaces to release stress that arises in the elastic member due to swelling caused by contacting with fuel. The elastic member is formed in a sheet. The elastic member is mounted to the sub-tank via an outer periphery of the elastic member. The spaces are arranged in a substantially circumferential direction of the sub-tank, or are arranged in a substantially radial direction of the sub-tank.

24 Claims, 9 Drawing Sheets

PUMP MODULE HAVING SUB-TANK AND ELASTIC MEMBER

CROSS REFERENCE TO RELATED APPLICATIONS

This application is based on and incorporates herein by reference Japanese Patent Applications No. 2004-100164 filed on Mar. 30, 2004 and No. 2005-23688 filed on Jan. 31, 2005.

FIELD OF THE INVENTION

The present invention relates to a pump module.

BACKGROUND OF THE INVENTION

In-tank type pump modules, which are accommodated in a fuel tank, are disclosed in JP-B2-2643436 (JP-A-2-277954) and JP-B2-2643461 (JP-A-3-50372). Each pump module includes a sub-tank. The sub-tank has a bottom wall, on which claws, which are resiliently deformable, are provided. The claws of the sub-tank contact the bottom wall of the fuel tank, so that the claws insulate vibration of a fuel pump that is accommodated in the sub-tank. Thus, noise due to vibration of the fuel pump is insulated.

However, the claws are small in the above structure, and the claws cannot sufficiently insulate vibration and noise. Therefore, a rubber sheet may be enlarged to entirely cover the bottom wall of the sub-tank, and the rubber sheet may be inserted between the bottom wall of the sub-tank and the bottom wall of the fuel tank to insulate vibration. However, the rubber sheet may swell due to contact with fuel, and stress may arise in the rubber sheet due to swelling. When the rubber sheet is large, the stress due to swelling may become large. As a result, the rubber sheet may be lifted relative to the sub-tank and the fuel tank, and vibration insulative property of the rubber sheet may be degraded.

SUMMARY OF THE INVENTION

In view of the foregoing problems, it is an object of the present invention to produce a pump module that is capable of insulating vibration.

According to the present invention, a pump module, which is mounted to a fuel tank, includes a sub-tank, a fuel pump, and an elastic member. The sub-tank is accommodated in the fuel tank. The fuel pump is accommodated in the sub-tank. The fuel pump pumps fuel, which is drawn into the sub-tank. The elastic member is formed of an elastomer. The elastic member is interposed between a bottom portion of the sub-tank and a bottom portion of the fuel tank. The elastic member makes contact with fuel. The elastic member defines at least one space to release stress that arises in the elastic member due to swelling.

The elastic member is formed in a sheet. The elastic member is mounted to the sub-tank via an outer periphery of the elastic member.

The elastic member defines multiple spaces. The multiple spaces are arranged in a substantially circumferential direction of the sub-tank. The multiple spaces are arranged in a substantially radial direction of the sub-tank. The elastic member defines the at least one space in the direction of thickness of the elastic member. The at least one space opens to an outer peripheral side of the elastic member.

The pump module further includes a biasing member that biases the sub-tank to a bottom portion of the fuel tank.

Alternatively, a pump module mounted to a fuel tank includes a sub-tank, a fuel pump, and an elastic member. The sub-tank is accommodated in the fuel tank. The fuel pump is accommodated in the sub-tank. The fuel pump pumps fuel, which is drawn into the sub-tank. The elastic member is formed of an elastomer, and is interposed between a bottom portion of the sub-tank and a bottom portion of the fuel tank. The elastic member makes contact with fuel.

The elastic member is formed in a sheet. The elastic member has a free portion that includes an outer periphery of the elastic member. The free portion of the elastic member is free with respect to the sub-tank. The elastic member has a mounted portion on an inner peripheral side of the free portion. The mounted portion of the elastic member is mounted to the sub-tank.

The sub-tank has a protruding portion that protrudes from a bottom portion of the sub-tank. The mounted portion of the elastic member defines a hole, through which the protruding portion penetrates the elastic member. The mounted portion is interposed between the protruding portion and the bottom wall of the sub-tank. That is, the mounted portion is supported by the protruding portion and the bottom wall of the sub-tank.

The sub-tank has a body member that forms the bottom portion of the sub-tank. The sub-tank has a separated member that is formed separately from the body member. The separated member is mounted to the body member, so that the separated member forms the protruding portion of the sub-tank.

The separated member has a fitting portion that is fitted to the mounted portion of the elastic member from the opposite side of the body member of the sub-tank. The separated member has a welded portion that is inserted into the hole of the mounted portion of the elastic member. The welded portion is welded with the body member of the sub-tank.

Alternatively, the body member of the sub-tank has an inserted portion that is inserted into the hole of the mounted portion of the elastic member. The separated member has a fitting portion that is fitted to the mounted portion of the elastic member from the opposite side of the body member of the sub-tank. The separated member has an engaging portion that is engaged with the inserted portion of the body member of the sub-tank. The outer periphery of the elastic member is in a substantially circular shape.

The elastic member is partially secured to a bottom portion of the sub-tank, so that the elastic member is partially free with respect to the sub-tank.

The elastic member has a mounted portion that is secured to the sub-tank. The elastic member has a free portion that includes an outer periphery of the elastic member. The elastic member is free with respect to the sub-tank at the free portion. The sub-tank has a bottom portion that has a protrusion protruding from the bottom portion to the sub-tank. The protrusion defines a circumferential groove on a radially outer periphery of the protrusion. The mounted portion of the elastic member is at least partially interposed within the circumferential groove of the protrusion of the bottom portion of the sub-tank in the direction of thickness of the elastic member.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
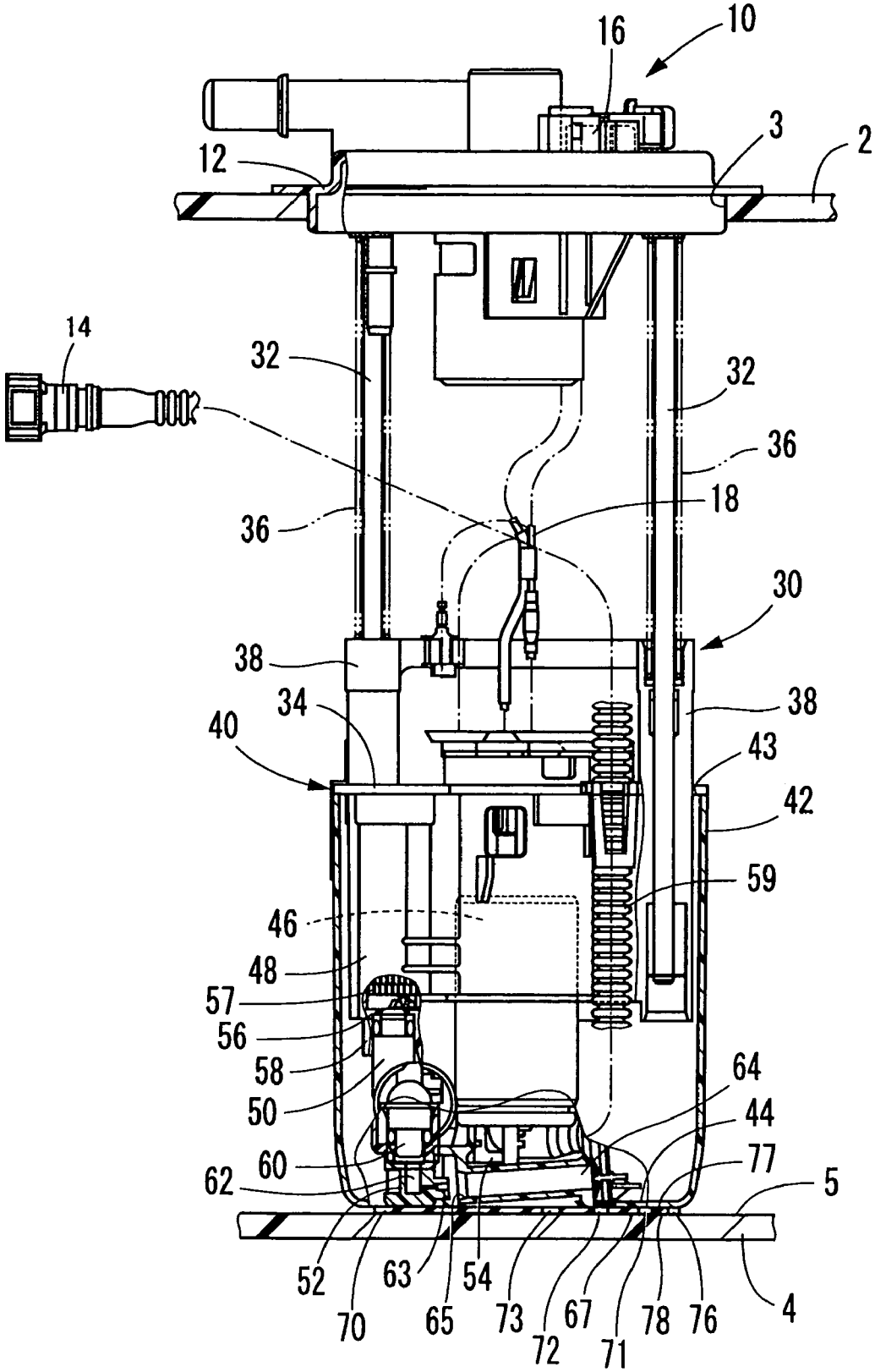
FIG. 1 is a partially cross-sectional side view showing a fuel feed apparatus including a pump module according to a first embodiment of the present invention.

As shown in FIG. 1, a fuel feed apparatus 10 has a flange 12 that is in a substantially circular shape. The flange 12 covers an opening 3 formed in a top wall 2 of the fuel tank. The flange 12 is provided with an electric connector 16. A pump module 40 includes a fuel pump 46 that is supplied with electricity via the electric connector 16 and a lead wire 18. A tank piping communicates the outside of the fuel tank with the inside of the fuel tank. A tank piping is connected with a fuel discharge pipe 14 in the fuel tank.

The fuel feed apparatus 10 includes an adjustment device 30, the pump module 40 and a resilient member 70 that are arranged on the lower side of the flange 12 in the fuel tank. The adjustment device 30 is constructed of struts 32, a cover 34, coil springs 36, and the like. The struts 32 are formed in a rod-shape that vertically extends. The cover 34 is attached on the upper side of the sub-tank 42 in the pump module 40, so that the cover 34 closes an opening formed in the sub-tank 42. The struts 32 are secured to the flange 12 on the upper side thereof. The struts 32 are slidably inserted into pipe portions 38 of the cover 34 on the lower side thereof. The pipe portions 38 move along the struts 32, so that physical relationship between the flange 12 and the pump module 40 can be vertically adjusted. Thereby, a position of the pump module 40 can be adjusted relative to the flange 12. The coil springs 36 serve as biasing members. Each coil spring 36 biases the cover 34 and the sub-tank 42 against a bottom wall (bottom portion) 4 of the fuel tank.

The fuel tank may expand due to change of inner pressure caused by change of temperature, and may expand due to change of an amount of fuel in the fuel tank. Even in this situation, biasing force is applied from the coil springs 36 against a bottom wall (bottom portion) 44 of the sub-tank 42, so that the bottom wall 44 of the sub-tank 42 is pressed onto the bottom wall 4 of the fuel tank via a biasing member 70. Thereby, a relative relationship between the pump module 40 with respect to the fuel tank can be maintained.

The pump module 40 is constructed of the sub-tank 42, a suction filter (not shown), the fuel pump 46, a fuel filter 48, a pressure regulator 50, a jet pump 52, and the like. The sub-tank 42 is formed of resin in a cup-shape. The fuel pump 46 is accommodated in the sub-tank 42 such that a fuel suction port 54 of the fuel pump 46 is arranged on the lower side, and a fuel discharge port of the fuel pump 46 is arranged on the upper side.

The fuel pump 46 generates suction pressure by rotating force of a motor (not shown). The fuel pump 46 draws fuel, which flows into the sub-tank 42 after passing through the suction filter, from the fuel suction port 54 by the suction pressure. The fuel pump 46 pressurizes fuel drawn from the sub-tank 42, and discharges the fuel through the fuel discharge port. The discharge port of the fuel pump 46 is connected with a fuel inlet of the fuel filter 48. The fuel filter 48 filters foreign matters contained in fuel discharged from the fuel pump 46 using a filter element 57 that is accommodated in a filter case 56. The pressure regulator 50 is connected with a fuel outlet 58 of the fuel filter 48, so that the pressure regulator 50 controls pressure of the fuel flowing out of the fuel filter 48 at a predetermined pressure. Fuel is controlled in pressure by the pressure regulator 50, and the fuel is introduced into the fuel discharge pipe 14 through a bellows pipe 59. The pressure regulator 50 exhausts surplus fuel, which is generated while controlling fuel in pressure, through a fuel exhaust port 60. The fuel exhaust port 60 of the pressure regulator 50 is connected with a fuel inlet port 62 of the jet pump 52. The jet pump 52 jets fuel exhausted from the pressure regulator 50 into a passage 64, which is formed in the bottom wall 44 of the sub-tank 42, through a jet nozzle 63. The jet of exhaust fuel generates negative pressure, which is lower than atmospheric pressure, in the passage 64. Thereby, fuel in the fuel tank is introduced into the sub-tank 42 through an introducing port 65 formed in the bottom wall 44 of the sub-tank 42.

Figure 2:
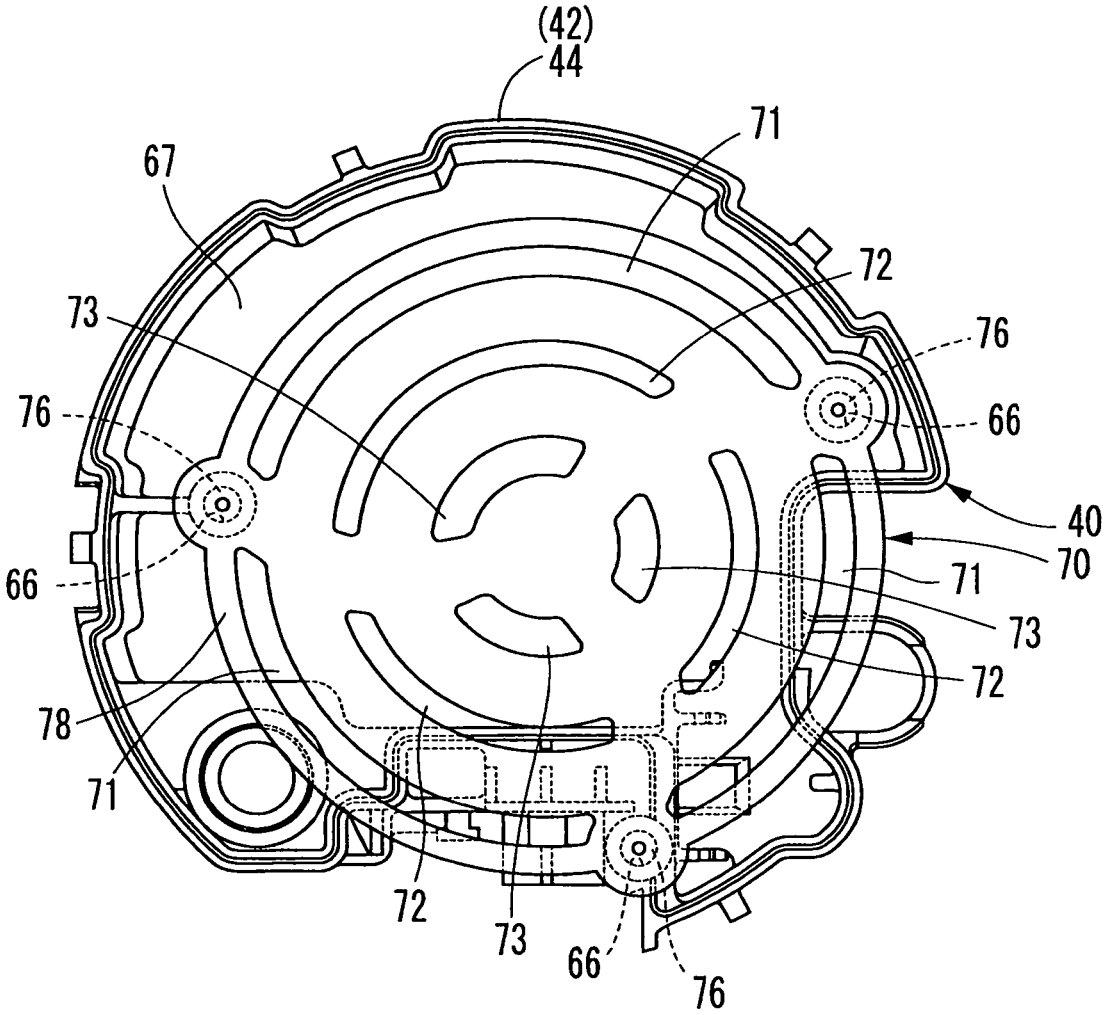
FIG. 2 is a bottom view showing a sub-tank and a biasing member of the pump module according to the first embodiment.

As shown in FIG. 2, the biasing member (elastic member) 70 is formed of an elastomer such as rubber having rubber-like elasticity to be in a substantially circular sheet. The elastic member 70 has first spaces 71, second spaces 72, and third spaces 73. The first, second, third spaces 71, 72, 73 are formed such that the elastic member 70 is penetrated in the thickness direction to define substantially arc shapes when being vied from the thickness direction of the elastic member 70. The elastic member 70 has three first spaces 71 that are arranged along the circumferential direction of the elastic member 70. The elastic member 70 has three second spaces 72 that are arranged along the circumferential direction of the elastic member 70. Each second space 72 is arranged on the inner circumferential side with respect to corresponding first space 71 in the elastic member 70. The elastic member 70 has three third spaces 73 that are arranged along the circumferential direction of the elastic member 70. Each third space 73 is arranged on the inner circumferential side with respect to corresponding second space 72 in the elastic member 70.

Thereby, the first, second, third spaces 71, 72, 73, which correspond to each other, are arranged in the radial direction from the center to the radially outer side in the elastic member 70.

The elastic member 70 has mounting portions 76 at three locations. Each mounting portions 76 are arranged between the first spaces 71 that are circumferentially adjacent to each other.

Figure 3:
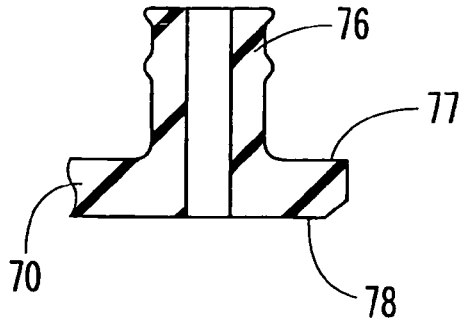
FIG. 3 is a cross-sectional side view showing a portion of the biasing member of the pump module according to the first embodiment.

As shown in FIG. 3, each mounting portion 76 is formed in a substantially cylindrical shape that protrudes from an end face 77 (FIG. 1) of the elastic member 70 on one side thereof. As referred to FIG. 2, each mounting portion 76 fits to one of three fitting holes 66 that are formed in the bottom wall 44 of the sub-tank 42. Thereby, the elastic member 70 is attached to the bottom wall 44 of the sub-tank 42, while the end face 77 of the elastic member 70 makes contact with an outer surface 67 of the bottom wall 44 of the sub-tank 42. The outer surface 67 of the bottom wall 44 opposes to the bottom wall 4 of the fuel tank.

An end face 78 (FIG. 3) of the elastic member 70 on the opposite side of the sub-tank 42 makes contact with an inner surface 5 of the bottom wall 4 of the fuel tank. The inner surface 5 of the bottom wall 4 of the fuel tank oppose to the bottom wall 44 of the sub-tank 42. The elastic member 70 is interposed between the bottom wall 44 of the sub-tank 42 and the bottom wall 4 of the fuel tank, and the elastic member 70 makes contact with fuel in the fuel tank.

As referred to FIG. 2, the elastic member 70 is formed in large such that the elastic member 70 covers a large region of the bottom wall 44 of the sub-tank 42. Accordingly, the elastic member 70 is apt to be swelled due to contact with fuel. Besides, the elastic member 70 is attached onto the bottom wall 44 of the sub-tank 42 on the circumferentially end portion thereof. Accordingly, stress arising in the elastic member 70 due to swelling is not apt to be released to the radially outer side of the elastic member 70.

However, in the above structure of the elastic member 70, stress (swelling stress) arising in the elastic member 70 due to swelling can be released to the first, second, third spaces 71, 72, 73, which are arranged in the radial direction and in the circumferential direction of the elastic member 70.

Especially, the elastic member 70, which is interposed between the bottom wall 44 of the sub-tank 42 and the bottom wall 4 of the fuel tank, is pressed by the coil springs 36. Thereby, swelling stress can be easily released to the first, second, third spaces 71, 72, 73, in which inner pressure is small.

In the structure of the elastic member 70, in which swelling stress is released in the above manner, expansion of the elastic member 70 is oriented to the first, second, third spaces 71, 72, 73, so that the elastic member 70 can be restricted from being lifted with respect to the sub-tank 42 and the fuel tank.

Thereby, vibration-insulating property can be restricted from being degraded due to swelling of the elastic member 70. Furthermore, the elastic member 70, which is large enough to entirely cover the bottom wall 44 of the sub-tank 42, is capable of enhancing vibration-insulating property against vibration of the fuel pump 46, so that noise can be reduced.

Furthermore, in the above structure, the elastic member 70, which is formed of elastomer, is interposed between the bottom wall 44 of the sub-tank 42 and the bottom wall 4 of the fuel tank. Thereby, both the outer surface 67 of the bottom wall 44 and the inner surface 5 of the bottom wall 4 of the fuel tank can be protected from abrasion.

Besides, in the above structure, the elastic member 70 is mounted onto the bottom wall 44 of the sub-tank 42. Thereby, the elastic member 70 can be interposed between the bottom walls 44, 4, simultaneously with mounting the pump module 40 in the fuel tank.

Besides, in the above structure, the first, second, third spaces 71, 72, 73 are formed in the elastic member 70 such that the first, second, third spaces 71, 72, 73 penetrate the elastic member 70 in the direction of thickness thereof. Thereby, the first, second, third spaces 71, 72, 73 can be easily formed.

Second Embodiment

Figure 4:
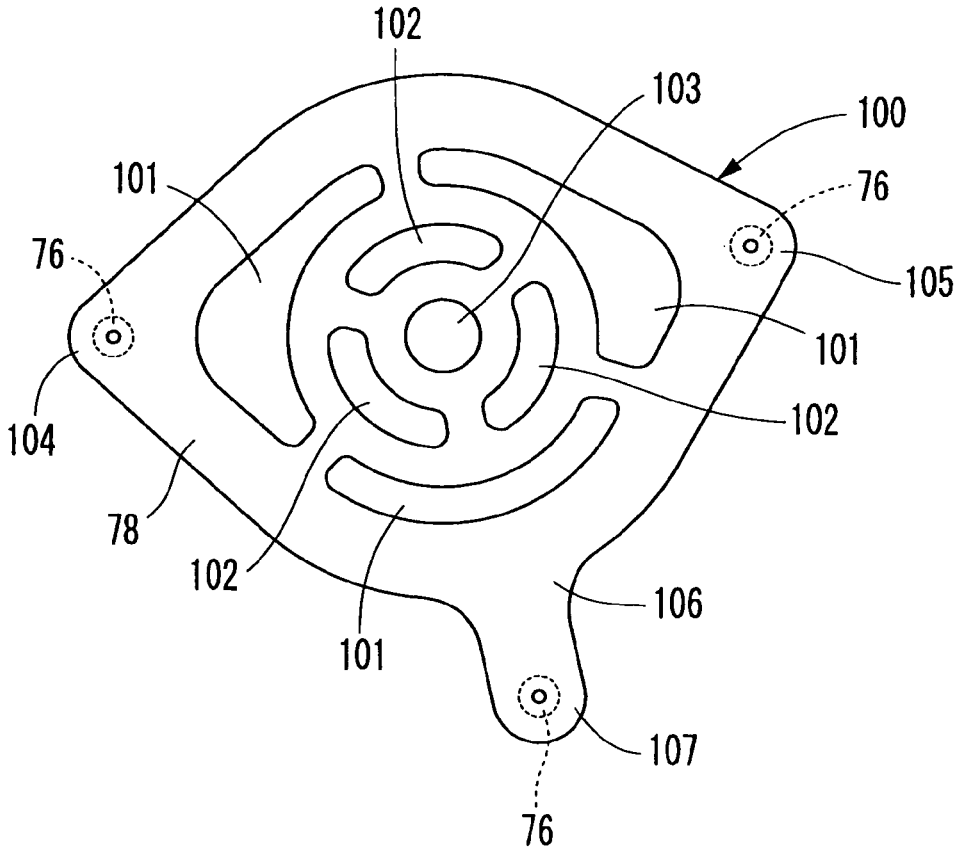
FIG. 4 is a bottom view showing a biasing member of a pump module according to a second embodiment of the present invention.

As show in FIG. 4, an elastic member 100 is formed in a substantially rhombic-shaped sheet. The elastic member 100 has three first spaces 101, three second spaces 102, and one third space 103. The first, second, third spaces 101, 102, 103 penetrate the elastic member 100 in the thickness direction thereof. The three first spaces 101 are arranged along the circumferential direction of the elastic member 100.

Two of the three first spaces 101 are respectively in substantially angular shapes, and remaining one of the three first spaces 101 is in a substantially arc shape, when being vied from the thickness direction of the elastic member 100. The second spaces 102 are arranged along the circumferential direction of the elastic member 100. Each second space 102 is in a substantially arc shape, when being vied from the thickness direction of the elastic member 100. Each second space 102 is arranged on the inner circumferential side with respect to corresponding two first spaces 101 in the elastic member 100 such that both ends of the second space 102 are arranged within the inner circumferential peripheries of corresponding two first spaces 101. The third space 103 is in a substantially circular shape, when being vied from the thickness direction of the elastic member 100. The third space 103 is arranged in the substantially center of the elastic member 100. Thereby, two second spaces 102, which correspond to each first space 101, and the third space 103 are arranged in the radial direction of the elastic member 100.

The substantially rhombic elastic member 100 has apexes 104, 105, 106. The apex 105 is arranged on the opposing corner of the apex 104 in the elastic member 100. The apex 106 is different from the apexes 104, 105. An arm 107 extends from the apex 106 to the radially outer side in the elastic member 100. Each mounting portion 76 is integrally formed with an end portion of each of the apexes 104, 105. Another mounting portion 76 is integrally formed with an end portion of the arm 107. The end portions of all the apexes 104, 105 and the arm 107 form an outer periphery of the elastic member 100.

Third Embodiment

Figure 5:
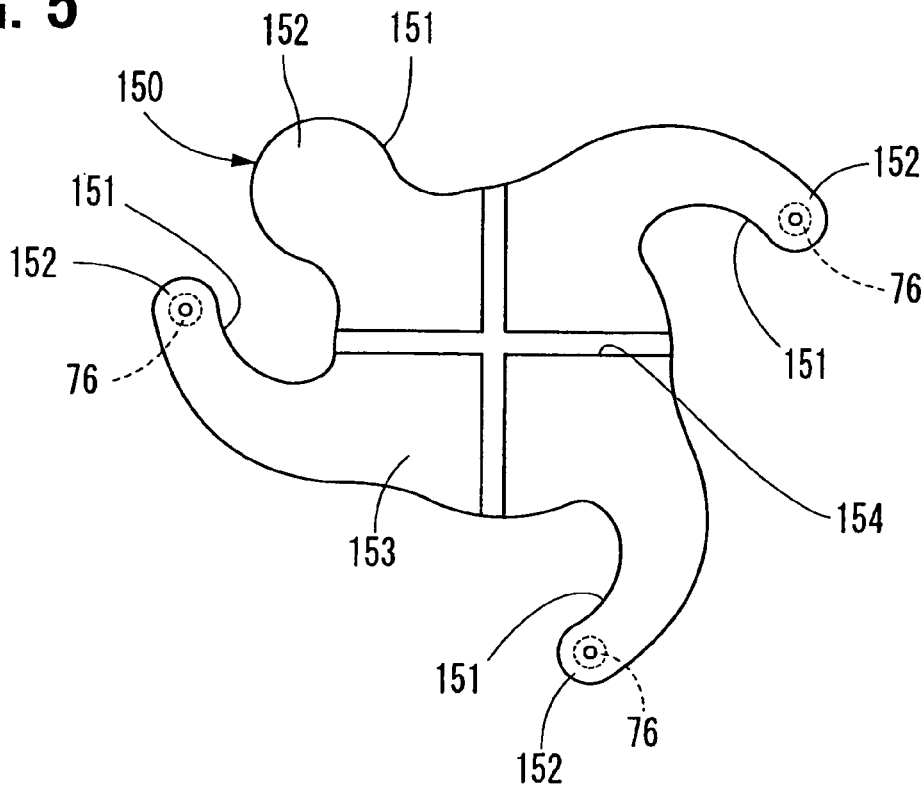
FIG. 5 is a bottom view showing a biasing member of a pump module according to a third embodiment of the present invention.

As show in FIG. 5, an elastic member 150 is formed in a substantially impeller-shaped sheet. The elastic member 150 has four spaces 151 that penetrate the elastic member 150 in the thickness direction thereof, and opens to the radially outer side of the elastic member 150. The four spaces 151 are arranged in the circumferential direction of the elastic member 150.

The elastic member 150 has four arms 152. Each arm 152 is arranged between the spaces 151 that are circumferentially adjacent to each other. Three of the four arms 152 respectively have the mounting portions 76. Each mounting portion 76 is integrally formed with each end of the three arms 152 that forms the outer periphery of the elastic member 150.

A groove 154 is formed in an end face 153 of the elastic member 150 on the opposite side of the sub-tank 42. The groove 154 has a depth such that the groove 154 does not penetrate the elastic member 150 in the thickness direction thereof.

Fourth Embodiment

Figure 6:
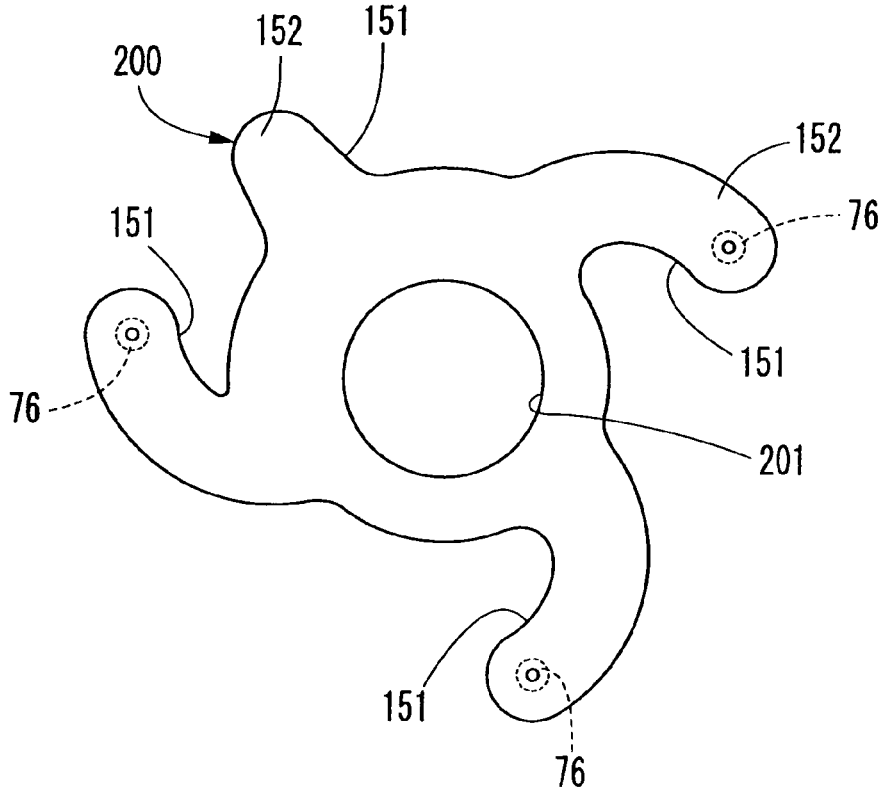
FIG. 6 is a bottom view showing a biasing member of a pump module according to a fourth embodiment of the present invention.

As show in FIG. 6, an elastic member 200 has the spaces 151 and the arms 152 similarly to the structure described in the third embodiment. The elastic member 200 has a space 201 in the center thereof. The space 201 is in a substantially circular shape, when being vied from the thickness direction of the elastic member 200.

In the structures described in the second to fourth embodiments, each elastic member 100, 150, 200 is interposed between the bottom wall 44 of the sub-tank 42 and the bottom wall 4 of the fuel tank, so that effects, which are similar to the effects described in the first embodiment, can be produced.

Fifth Embodiment

The structure to be described in the fifth embodiment is a modification of the structure described in the first embodiment.

Figure 7:
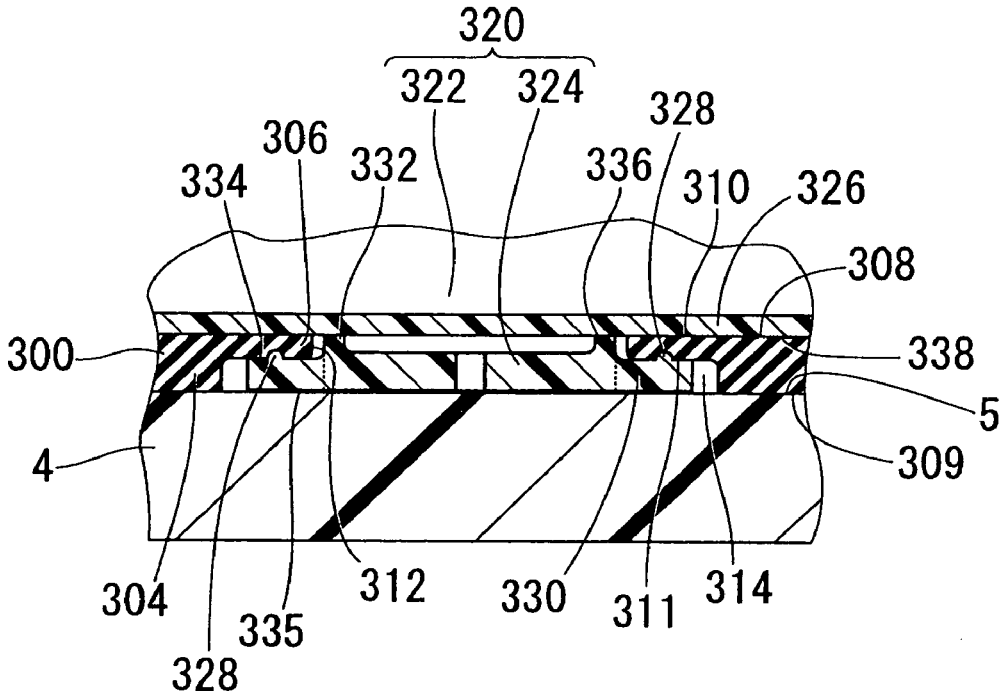
FIG. 7 is a cross-sectional side view showing a sub-tank and a biasing member of a pump module according to a fifth embodiment of the present invention.
Figure 8A:
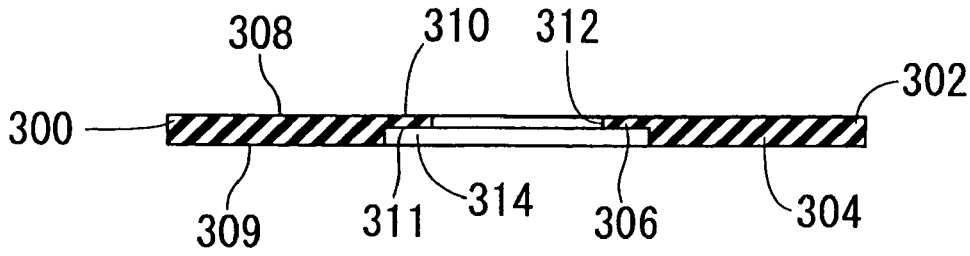
FIG. 8A is a cross-sectional side view showing the biasing member of the pump module.
Figure 8B:
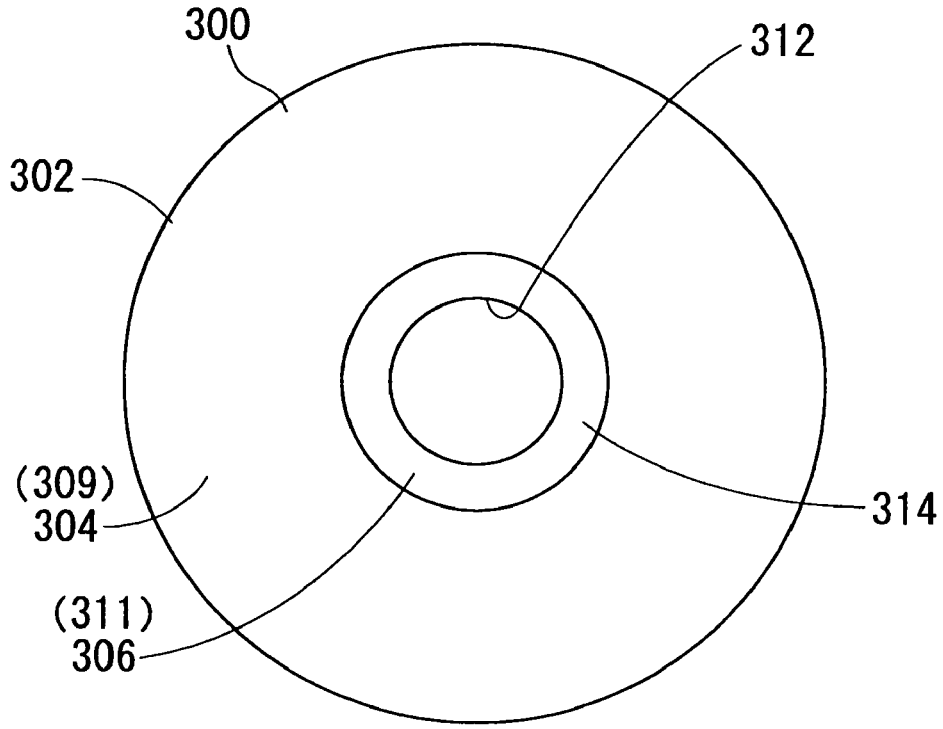
FIG. 8B is a bottom view showing the biasing member according to the fifth embodiment.

As shown in FIGS. 7, 8A, 8B, an elastic member 300 is formed of an elastomer in a substantially circular shaped sheet. The elastic member 300 is interposed between the bottom wall 4 of the fuel tank and a bottom wall 326 of a sub-tank 320. The elastic member 300 has a free portion 304 and a mounted portion 306. The free portion 304 includes an outer peripheral portion 302 of the elastic member 300. The mounted portion 306 is provided on the inner side of the free portion 304.

The free portion 304 is formed in an annular plate shape that has a specific thickness. The free portion 304 has one end face 308 that makes contact with an outer surface 338 of the bottom wall 326 of the sub-tank 320 in a free condition. The free portion 304 has the other end face 309 that makes contact with the inner surface 5 of the bottom wall 4 of the fuel tank in a free condition. Therefore, the free portion 304 is not fixed to the bottom walls 326, 4 of the sub-tank 320 and the fuel tank.

The mounted portion 306 of the elastic member 300 is formed in an annular plate shape that has a thickness smaller than the thickness of the free portion 304. The mounted portion 306 defines a hole 312 that penetrates the mounted portion 306 from one end face 310 to the other end face 311 thereof in the thickness direction. The one end face 310 of the mounted portion 306 flatly connects with the one end face 308 of the free portion 304. The one end face 310 of the mounted portion 306 makes contact with the outer surface 338 of the bottom wall 326 of the sub-tank 320.

The other end face 311 of the mounted portion 306 is dented from the other end face 309 of the free portion 304 to the side of the sub-tank 320, so that a recess 314 is formed. The sub-tank 320 has a fitting portion 330 that is received in the recess 314 (FIG. 7). The fitting portion 330 of the sub-tank 320 makes contact with the other end face 311 of the mounted portion 306 in the recess 314. Therefore, the bottom wall 326 of the sub-tank 320 and the fitting portion 330 of the sub-tank 320 fits to the mounted portion 306 from both sides thereof, so that the mounted portion 306 is mounted to the sub-tank 320.

Figure 9:
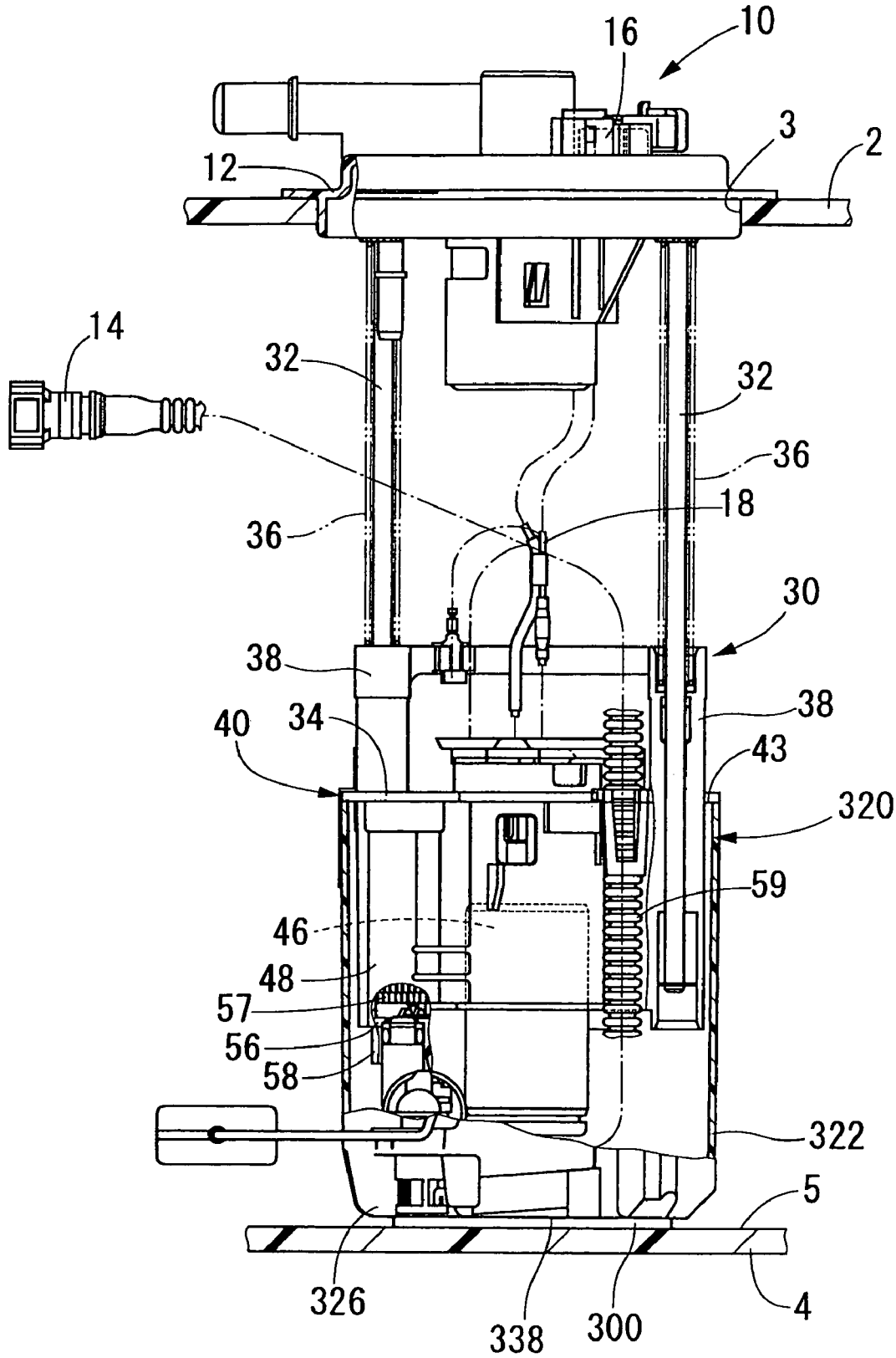
FIG. 9 is a partially cross-sectional side view showing a fuel feed apparatus including the pump module according to the fifth embodiment.

As referred to FIGS. 7, 9, the sub-tank 320 is constructed of a body member 322 and a member (separated member) 324 in the fifth embodiment. The separated member 324 is separated from the body member 322. The body member 322 has a substantially equivalent structure as the structure of the sub-tank 42 described in the first embodiment, excluding that the fitting holes 66 need not to be formed in the body member 322. As referred to FIG. 9, the body member 322 has a bottom wall 326 on the lower side of the fuel pump 46 accommodated therein.

As referred to FIGS. 7, 10, the separated member 324, which is formed of resin, includes the fitting portion 330 and a welded portion 332. The dotted line in FIG. 7 shows a boundary between the fitting portion 330 and the welded portion 332. The fitting portion 330 fits to the mounted portion 306 from the opposite side of the body member 322. The welded portion 332 is inserted into the hole 312 of the mounted portion 306, and welded with the bottom wall 326 of the body member 322.

The fitting portion 330 of the separated member 324 is in an annular plate shape that has the outer diameter less than the outer diameter of the mounted portion 306 of the elastic member 300. The fitting portion 330 has the inner diameter that is less than the inner diameter of the mounted portion 306. The fitting portion 330 has the thickness that is substantially equal to or less than the depth of the recess 314 of the elastic member 300. The fitting portion 330 of the separated member 324 has an end face 334, on which the fitting portion 330 of the separated member 324 makes contact with the mounted portion 306 of the elastic member 300.

The fitting portion 330 has an end face 335, which is on the opposite side of the end face 334. The end face 335 of the fitting portion 330 makes contact with the inner surface 5 of the bottom wall 4 of the fuel tank in a free condition. Alternatively, the end face 335 of the fitting portion 330 opposes to the inner surface 5 of the bottom wall 4 of the fuel tank via a gap.

The fitting portion 330 of the separated member 324 in this embodiment further includes multiple protrusions 328 that respectively protrude from the end face 334 of the fitting portion 330 toward the sub-tank 320. The protrusions 328 are circumferentially arranged on the end face 334 of the fitting portion 330 at substantially regular intervals. Each protrusion 328 is in a hemispherical shape, and dents into the mounted portion 306 of the elastic member 300, so that the elastic member 300 is restricted from being misaligned relative to the sub-tank 320.

The welded portion 332 of the separated member 324 is in a bottomed cylindrical shape that has the outer diameter less than the inner diameter of the hole 312 of the mounted portion 306 of the elastic member 300. The welded portion 332 has the height that is substantially equal to or less than the thickness of the free portion 304 of the elastic member 300 before a welding process, in which the welded portion 332 is welded to the body member 322 of the sub-tank 320.

The bottom side of the welded portion 332 connects to the inner circumferential periphery of the fitting portion 330 in the separated member 324. The welded portion 332 has an end face 336 of the opening side thereof. The end face 336 of the welded portion 332 is welded with the outer surface 338 of the bottom wall 326 of the body member 322 of the sub-tank 320. Thereby, the separated member 324 entirely protrudes from the bottom wall 326 of the body member 322.

The fitting portion 330 forms an end portion of the separated member 324 protruding from the bottom wall 326 of the body member 322. The mounted portion 306 of the elastic member 300 is interposed between the fitting portion 330 of the separated member 324 and the bottom wall 326 of the body member 322. Therefore, in this embodiment, the separated member 324, which protrudes from the bottom wall 326 of the body member 322, penetrates through the hole 312 of the mounted portion 306 of the elastic member 300.

Figure 10A:
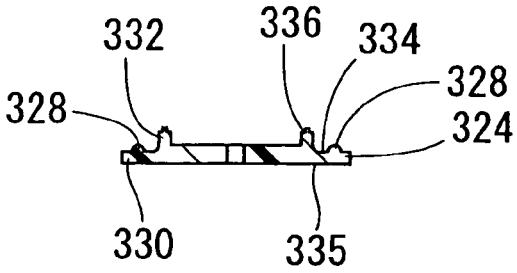
FIG. 10A is a cross-sectional side view showing a separated member of the biasing member of the pump module.
Figure 10B:
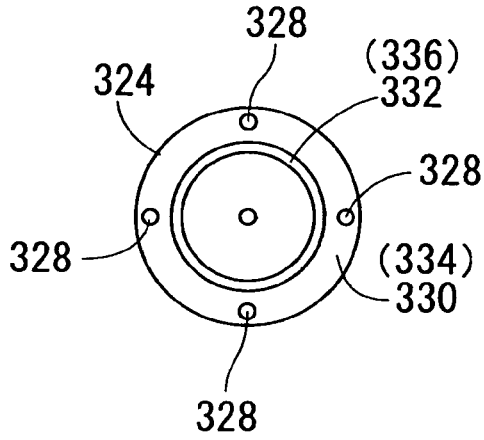
FIG. 10B is a top view showing the separated member according to the fifth embodiment.

Next, the welding process, in which the welded portion 332 of the separated member 324 is welded with the body member 322 of the sub-tank 320, is described. The elastic member 300 shown in FIGS. 8A, 8B, the body member 322 shown in FIG. 9, and the separated member 324 shown in FIGS. 10A, 10B are prepared.

Figure 11A:
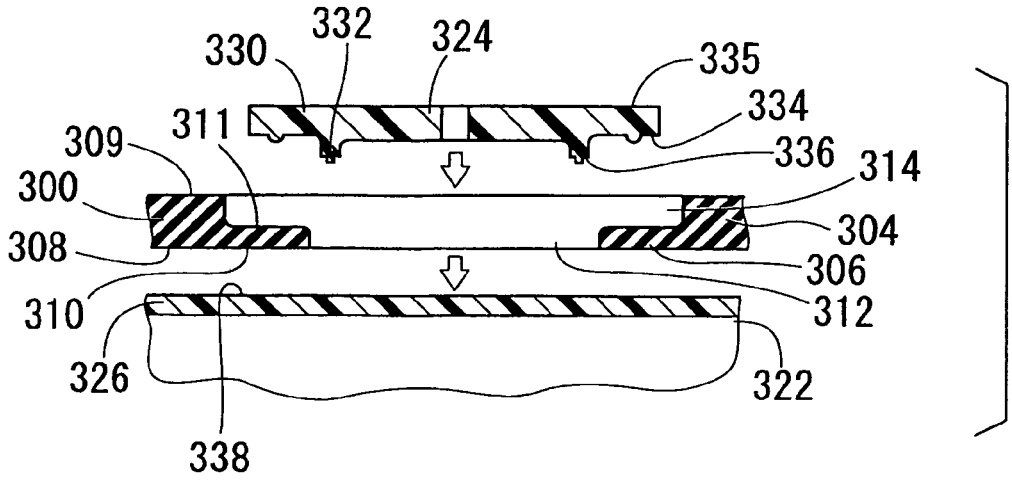
FIGS. 11A, 11B are schematic side views showing a welding work for welding the main member of the pump module with the separated member according to the fifth embodiment.
Figure 11B:
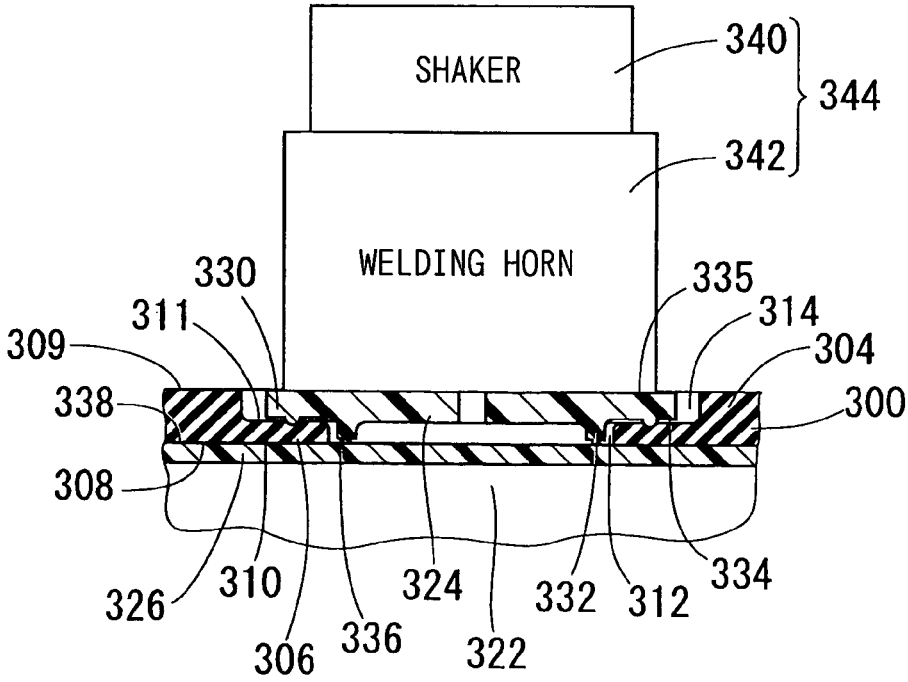

As shown in FIG. 11A, the elastic member 300 and the separated member 324 are placed on the outer surface 338 of the bottom wall 326 of the body member 322 of the sub-tank 320 in order. Thereby, as shown in FIG. 11B, the welded portion 332 of the separated member 324 is inserted into the hole 312 of the mounted portion 306 of the elastic member 300, so that the mounted portion 306 is interposed between the fitting portion 330 of the separated member 324 and the bottom wall 326 of the body member 322. Subsequently, an ultrasonic welding apparatus 344, which includes a shaker 340 and a welding horn 342, is set on the end face 335 of the fitting portion 330 of the separated member 324. The ultrasonic welding apparatus 344 is operated, and ultrasonic vibration generated in the shaker 340 is transmitted to the separated member 324 via the welding horn 342, so that the end face 336 of the welded portion 332 is welded with the outer surface 338 of the bottom wall 326 of the body member 322. Thus, the mounted portion 306 of the elastic member 300 is secured between the fitting portion 330 of the separated member 324 and the bottom wall 326 of the body member 322.

As referred to FIG. 9, in the structure of this embodiment, the elastic member 300 is formed large to cover a wide region of the bottom wall 326 of the body member 322. Accordingly, the elastic member 300 is apt to be swelled and expanded due to contact with fuel.

However, the elastic member 300 is mounted to the sub-tank 320 such that the portion of the elastic member 300, which is on the radially inner side of the free portion 304, is secured to the sub-tank 320. The free portion 304 is free with respect to the sub-tank 320. Thereby, stress (swelling stress) arising due to swelling of the elastic member 300 can be released to the radially outer side of the elastic member 300 via the free portion 304. Specifically, the elastic member 300, which is interposed between the bottom wall 326 of the body member 322 and the bottom wall 4 of the fuel tank, is pressed by biasing force of the coil springs 36, similarly to the structure described in the first embodiment. Thereby, swelling stress can be easily released to the outer space of the elastic member 300, in which pressure is small. In this structure of the elastic member 300, in which swelling stress is released in the above manner, expansion of the elastic member 300 is oriented to the radially outer side, so that the elastic member 300 can be restricted from being lifted with respect to the sub-tank 320 and the fuel tank.

Thereby, vibration-insulating property can be restricted from being degraded due to swelling of the elastic member 300. Furthermore, the elastic member 300, which is large enough to entirely cover the bottom wall 326 of the sub-tank 320, is capable of enhancing vibration-insulating property against vibration of the fuel pump 46, so that noise can be reduced.

Besides, in the structure of this embodiment, the elastic member 300 is mounted onto the bottom wall 326 of the sub-tank 320. Thereby, the elastic member 300 can be interposed between the bottom walls 326, 4, simultaneously with mounting the pump module 40 in the fuel tank.

Besides, in the structure of this embodiment, the mounted portion 306 of the elastic member 300 is interposed between the fitting portion 330 of the separated member 324 and the bottom wall 326 of the sub-tank 320. The separated member 324 is welded with the sub-tank 320. Thereby, the elastic member 300 can be restricted from being removed away from the sub-tank 320, when the pump module 40 is mounted in the fuel tank, for example.

Furthermore, in the structure of this embodiment, the separated member 324 includes the fitting portion 330 that sandwiches the elastic member 300 with the body member 322 of the sub-tank 320, and the fitting portion 330 is welded to the bottom wall 326 of the body member 322 via the welded portion 332 of the separated member 324. The fitting portion 330 of the separated member 324 and the bottom wall 326 of the body member 322 of the sub-tank 320 are provided as separated members, i.e., the separated member 324 and the body member 322. Thereby, the sandwich structure of the elastic member 300 can be easily formed with the separated members.

Sixth Embodiment

Figure 12:
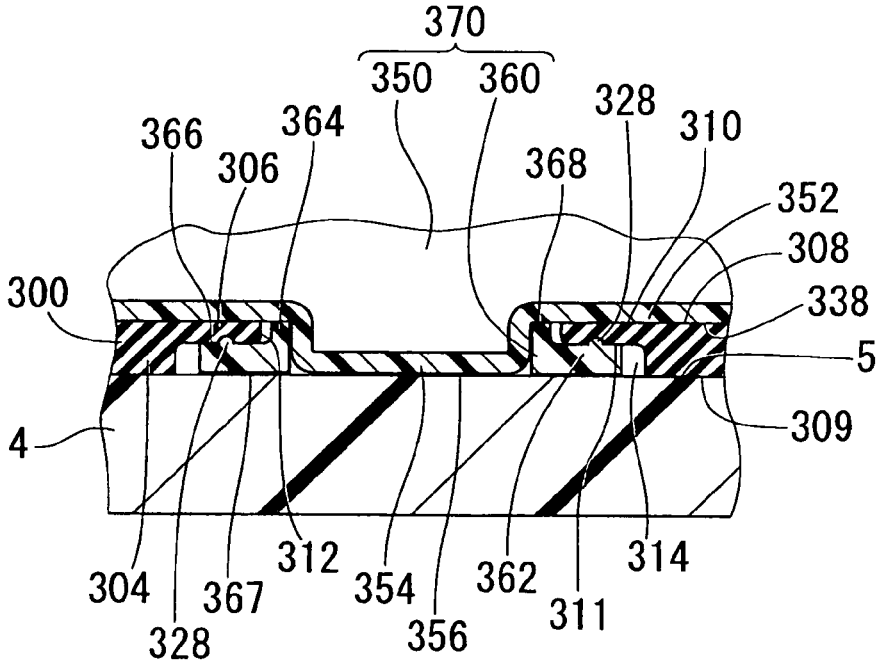
FIG. 12 is a cross-sectional side view showing a sub-tank and a biasing member of a pump module according to a sixth embodiment of the present invention.

The structure of this embodiment shown in FIG. 12 is a modification of the structure described in the fifth embodiment. In this embodiment, a body member 350 of a sub-tank 370 includes a bottom wall 352 that has a center portion, which is dented to the side of the elastic member 300 to be an inserted portion (protruding portion) 354. The inserted portion 354 is inserted into the hole 312 of the elastic member 300. The inserted portion 354 is formed to be in a bottomed cylindrical shape that has the diameter, which is less than the inner diameter of the hole 312 of the elastic member 300.

The inserted portion 354 has the height that is substantially equal to or less than the thickness of the free portion 304 of the elastic member 300 before a fitting process, in which an engaging portion 364 of a separated member 360 is fitted to the inserted portion 354 of the body member 350 of the sub-tank 370. In this structure, an end face 356 of the inserted portion 354 on the side of the bottom of the sub-tank 370 makes contact with the inner surface 5 of the bottom wall 4 of the fuel tank in a free condition. Alternatively, the end face 356 of the inserted portion 354 opposes to the inner surface 5 of the bottom wall 4 of the fuel tank via a gap. The body member 350 has a substantially equivalent structure as the structure of the body member 322 described in the fifth embodiment, excluding the structure described above.

In the above structure of the sixth embodiment, the separated member 360 includes a fitting portion 362 and the engaging portion 364. The fitting portion 362 of the separated member 360 is fitted to the mounted portion 306 of the elastic member 300 from the opposite side of the body member 350 of the sub-tank 370. The engaging portion 364 of the separated member 360 is inserted into the hole 312 of the elastic member 300, so the engaging portion 364 is engaged with the inserted portion 354 of the body member 350 of the sub-tank 370.

The fitting portion 362 of the separated member 360 is in an annular plate shape that has the outer diameter less than the outer diameter of the mounted portion 306 of the elastic member 300. The fitting portion 362 has the inner diameter that is less than the inner diameter of the mounted portion 306. The fitting portion 362 has the thickness that is substantially equal to the thickness of the fitting portion 330 of the separated member 324 in the fifth embodiment.

The fitting portion 362 of the separated member 360 has an end face 366, on which the fitting portion 362 makes contact with the mounted portion 306 of the elastic member 300. The fitting portion 362 has an end face 367, which is on the opposite side of the end face 366. The end face 367 of the fitting portion 362 makes contact with the inner surface 5 of the bottom wall 4 of the fuel tank in a free condition. Alternatively, the end face 367 of the fitting portion 362 opposes to the inner surface 5 of the bottom wall 4 of the fuel tank via a gap.

The fitting portion 362 of the separated member 360 in this embodiment includes the multiple protrusions 328 that respectively protrude from the end face 366 of the fitting portion 362 toward the sub-tank 370, in the same manner as the structure of the fifth embodiment.

The engaging portion 364 of the separated member 360 is formed to be in a cylindrical shape without a bottom portion. The engaging portion 364 has the diameter, which is less than the inner diameter of the hole 312 of the elastic member 300. The engaging portion 364 has the height that is substantially equal to the height of the welded portion 332 of the separated member 324 in the fifth embodiment.

One end side of the engaging portion 364 connects to the inner circumferential periphery of the fitting portion 362 in the separated member 360. The end face 368 of the engaging portion 364 on the other end side makes contact with of the body member 350 of the sub-tank 370. The inserted portion 354 of the body member 350 is inserted, e.g., press-inserted into the inner circumferential periphery of the engaging portion 364 of the separated member 360, so that the body member 350 is engaged with the separated member 360.

Thereby, the separated member 360 entirely protrudes from the bottom wall 352 of the body member 350 with the inserted portion 354 of the body member 350. The fitting portion 362 forms an end portion of the separated member 360 protruding from the bottom wall 352 of the body member 350. The mounted portion 306 of the elastic member 300 is interposed between the fitting portion 362 of the separated member 360 and the bottom wall 352 of the body member 350. Therefore, in this embodiment, the separated member 360 protrudes from the bottom wall 352 of the body member 350 with the inserted portion 354 of the body member 350 to form a penetrating portion that penetrates through the hole 312 of the mounted portion 306 of the elastic member 300.

In the structure of this embodiment, the engaging portion 364 of the separated member 360 may be welded with the inserted portion 354 of the body member 350 after the engaging portion 364 is engaged with the inserted portion 354, so that the engaging portion 364 can be steadily secured to the inserted portion 354.

In the structure of this embodiment, the separated member 360 may be formed of resin or metal. When the separated member 360 is welded with the sub-tank 370, the separated member 360 is preferably formed of resin.

In the structure of this embodiment, the free portion 304 including the outer peripheral portion 302 of the elastic member 300 is in a free condition relative to the sub-tank 370 that is constructed of the body member 350 and the separated member 360. The mounted portion 306, which is provided on the inner side of the free portion 304 in the elastic member 300, is interposed between the bottom wall 352 of the body member 350 and the fitting portion 362 of the separated member 360, so that the mounted portion 306 is mounted to the bottom wall 352. Thereby, the structure in this embodiment can produce an effect, which is equivalent to the effect described in the fifth embodiment.

The structure of the present invention is not limited to the above embodiments.

The relative relation ship of the pump module with respect to the bottom wall of the fuel tank may be fixed, and the sub-tank may not be pressed against the bottom wall of the fuel tank.

The space of the elastic member can be formed such that the space does not penetrate the elastic member in the thickness direction thereof. That is, a groove, a concavity may be formed on the elastic member as a space, in which swelling stress is released.

In the structures of the fifth and sixth embodiments, the elastic member 300 has the outer circumferential periphery in a substantially circular shape, so that the elastic member can be easily formed. However, the shape of the elastic member is not limited to the shape described above, and the elastic member can be formed in any other shapes.

In the above structures of the first to fourth embodiments, the elastic member formed in a sheet shape is mounted to the sub-tank via the outer periphery of the elastic member. Accordingly, the elastic member makes contact with fuel, and swelling stress arises in the elastic member. In this situation, swelling stress is not apt to be released to the radially outer side, i.e., circumferentially outer side of the elastic member. However, the spaces are formed in the elastic member, so that the elastic member can be steadily restricted from lifting, and vibration insulating property can be steadily restricted from being degraded.

In the above structures of the first and second embodiments, the spaces are formed in the circumferential direction of the sub-tank and in the radial direction of the sub-tank, so that vibration insulating property can be further restricted from being degraded, even the elastic member is swelled.

In the above structures of the first to fourth embodiments, the spaces are formed in the elastic member, which is formed in a sheet shape, such that the spaces penetrate the elastic member in the direction of the thickness thereof. Thereby, the spaces can be easily formed in the elastic member.

In the above structures of the third and fourth embodiments, the spaces are formed in the elastic member, which is formed in a sheet shape, such that the spaces respectively open to the outer circumferential side of the elastic member. Thereby, the spaces can be easily formed in the elastic member.

The above embodiments can be combined as appropriate.

Various modifications and alternations may be diversely made to the above embodiments without departing from the spirit of the present invention.

What is claimed is:

1. A pump module mounted to a fuel tank, the pump module comprising:

a sub-tank that is accommodated in the fuel tank;

a fuel pump that is accommodated in the sub-tank, the fuel pump pumping fuel, which is drawn into the sub-tank; and an elastic member that is formed of an elastomer, the elastic member interposed between a bottom portion of the sub-tank and a bottom portion of the fuel tank, the elastic member making contact with fuel, wherein the elastic member defines at least one space to release stress that arises in the elastic member due to swelling, and wherein the elastic member defines a plurality of spaces, and the plurality of spaces is arranged in a substantially circumferential direction of the sub-tank.

2. The pump module according to claim 1 wherein the elastic member is mounted to the sub-tank.

3. The pump module according to claim 1 wherein:

the elastic member is formed in a sheet, and the elastic member is mounted to the sub-tank via an outer periphery of the elastic member.

4. The pump module according to claim 1 wherein:

the elastic member is formed in a sheet, and the elastic member defines the at least one space in a direction of thickness of the elastic member.

5. The pump module according to claim 1 wherein:

the elastic member is formed in a sheet, and the at least one space opens to an outer peripheral side of the elastic member.

6. The pump module according to claim 1 further comprising:

a biasing member that biases the sub-tank to a bottom portion of the fuel tank.

7. A pump module mounted to a fuel tank, the pump module comprising:

a sub-tank that is accommodated in the fuel tank;

a fuel pump that is accommodated in the sub-tank, the fuel pump pumping fuel, which is drawn into the sub-tank; and an elastic member that is formed of an elastomer, the elastic member interposed between a bottom portion of the sub-tank and a bottom portion of the fuel tank, the elastic member making contact with fuel, wherein the elastic member defines at least one space to release stress that arises in the elastic member due to swelling, and wherein the elastic member defines a plurality of spaces, and the plurality of spaces is arranged in a substantially radial direction of the sub-tank.

8. The pump module according to claim 7 wherein the elastic memeber is mounted to the sub-tank.

9. The pump module according to claim 7 wherein:

the elastic member is formed in a sheet, and the elastic member is mounted to the sub-tank via an outer periphery of the elastic member.

10. The pump module according to claim 7 wherein:

the elastic member is formed in a sheet, and the elastic member defines the at least one space in a direction of thickness of the elastic member.

11. The pump module according to claim 7 wherein:

the elastic member is formed in a sheet, and the at least one space opens to an outer peripheral side of the elastic member.

12. The pump module according to claim 7, further comprising:

a biasing member that biases the sub-tank to a bottom portion of the fuel tank.

13. A pump module mounted to a fuel tank, the pump module comprising:

a sub-tank that is accommodated in the fuel tank;

a fuel pump that is accommodated in the sub-tank, the fuel pump pumping fuel, which is drawn into the sub-tank; and an elastic member that is formed of an elastomer, the elastic member interposed between a bottom portion of the sub-tank and a bottom portion of the fuel tank, the elastic member making contact with fuel, wherein the elastic member is formed in a sheet, the elastic member has a free portion that includes an outer periphery of the elastic member, the free portion of the elastic member is free with respect to the sub-tank, the elastic member has a mounted portion on an inner peripheral side of the free portion, and the mounted portion of the elastic member is mounted to the sub-tank.

14. The pump module according to claim 13, wherein the sub-tank has a protruding portion that protrudes from the bottom portion of the sub-tank, the mounted portion of the elastic member defines a hole through which the protruding portion penetrates the elastic member, and the mounted portion is interposed between the protruding portion and the bottom wall of the sub-tank.

15. The pump module according to claim 13, wherein the sub-tank has a protruding portion that protrudes from the bottom portion of the sub-tank, the mounted portion of the elastic member defines a hole through which the protruding portion penetrates the elastic member, and the mounted portion is supported by the protruding portion and the bottom wall of the sub-tank.

16. The pump module according to claim 14, wherein the sub-tank has a body member that forms the bottom portion of the sub-tank, the sub-tank has a separated member that is formed separately from the body member, and the separated member is mounted to the body member so that the separated member forms the protruding portion of the sub-tank.

17. The pump module according to claim 16, wherein the separated member has a fitting portion that is fitted to the mounted portion of the elastic member from an opposite side of the body member of the sub-tank, the separated member has a welded portion that is inserted into the hole of the mounted portion of the elastic member, and the welded portion is welded with the body member of the sub-tank.

18. The pump module according to claim 16, wherein the body member of the sub-tank has an inserted portion that is inserted into the hole of the mounted portion of the elastic member, the separated member has a fitting portion that is fitted to the mounted portion of the elastic member from an opposite side of the body member of the sub-tank, and the separated member has an engaging portion that is engaged with the inserted portion of the body member of the sub-tank.

19. The pump module according to claim 13, wherein the outer periphery of the elastic member is in a substantially circular shape.

20. The pump module according to claim 13, further comprising:

a biasing member that biases the sub-tank to a bottom portion of the fuel tank.

21. A pump module mounted to a fuel tank, the pump module comprising:

a sub-tank that is accommodated in the fuel tank;

a fuel pump that is accommodated in the sub-tank, the fuel pump pumping fuel, which is drawn into the sub-tank; and an elastic member that is formed of an elastomer, the elastic member interposed between a bottom portion of the sub-tank and a bottom portion of the fuel tank, the elastic member making contact with fuel, wherein the elastic member is formed in a sheet, and the elastic member is partially secured to a bottom portion of the sub-tank, so that the elastic member is partially free with respect to the sub-tank.

22. The pump module according to claim 21, wherein the elastic member has a mounted portion that is secured to the sub-tank, the elastic member has a free portion that includes an outer periphery of the elastic member, and the elastic member is free with respect to the sub-tank at the free portion.

23. The pump module according to claim 22, wherein the sub-tank has a bottom portion that has a protrusion protruding from the bottom portion to the sub-tank, the protrusion defines a circumferential groove on a radially outer periphery of the protrusion, and the mounted portion of the elastic member is at least partially interposed within the circumferential groove of the protrusion of the bottom portion of the sub-tank in a direction of thickness of the elastic member.

24. The pump module according to claim 22, wherein the free portion of the elastic member is movable with respect to the sub-tank in a direction of a width of the elastic member.

* * * * *